US006247338B1

(12) United States Patent
Ganor et al.

(10) Patent No.: US 6,247,338 B1
(45) Date of Patent: Jun. 19, 2001

(54) SELECTOR FOR KNITTING MACHINE

(75) Inventors: Ze'ev Ganor, Herzelia; Izhak Rafaeli, Haifa, both of (IL)

(73) Assignee: Nanomotion, Yokneam (IL)

( * ) Notice: Subject to any disclaimer, the term of this patent is extended or adjusted under 35 U.S.C. 154(b) by 0 days.

(21) Appl. No.: 09/582,146

(22) PCT Filed: Dec. 24, 1997

(86) PCT No.: PCT/IL97/00426

§ 371 Date: Jun. 21, 2000

§ 102(e) Date: Jun. 21, 2000

(87) PCT Pub. No.: WO99/34048

PCT Pub. Date: Jul. 8, 1999

(51) Int. Cl.[7] ..... D04B 15/78
(52) U.S. Cl. ..... 66/218
(58) Field of Search ..... 66/218, 219, 220, 66/221, 222, 215, 216, 217

(56) References Cited

U.S. PATENT DOCUMENTS 3,961,501 * 6/1976 Martinetz ..... 66/218
5,027,619 * 7/1991 Saito ..... 66/218
5,042,274 * 8/1991 Maruyama et al. ..... 66/218
5,453,653 9/1995 Zumeris .
5,616,980 * 4/1997 Zumeris ..... 310/323
5,823,015 * 10/1998 Shibata ..... 66/218
5,834,879 * 11/1998 Watanabe et al. ..... 310/328
6,064,140 * 5/2000 Zumeris ..... 310/323.02

FOREIGN PATENT DOCUMENTS

210790 * 2/1987 (EP) ..... 66/218
0 784 349 7/1997 (EP) .
0 796 939 9/1997 (EP) .

* cited by examiner

*Primary Examiner*—Danny Worrell
(74) *Attorney, Agent, or Firm*—Ferster & Company Patent Attorneys Ltd.

(57) ABSTRACT

The present invention provides a method for rapidly switching selector feet (52) between activate and deactivate selection positions by friction coupling them to vibratory piezoelectric motors (58) and a fast selector (50) for a knitting machine comprising selector feet friction coupled to piezoelectric motors.

36 Claims, 4 Drawing Sheets

SELECTOR FOR KNITTING MACHINE

FIELD OF THE INVENTION

The present invention relates to knitting machines, and in particular to selectors which select which latch needles of a knitting machine are activated in the process of knitting a fabric.

BACKGROUND OF THE INVENTION

Automatic knitting machines use banks of large numbers of closely spaced latch needles to interlock threads in a series of connected loops to produce a knitted fabric. The latch needle is a flat needle generally with a long shaft having, at one end, a small hook with a latch, which latch swivels to open and close the hook.

Generally, in a modem knitting machine, many thousands of latch needles are accurately positioned and maintained in a closely packed parallel array. In the process of knitting a fabric, an activation station activates latch needles by moving them forwards and backwards, parallel to their lengths, so that the hook ends of the activated latch needles move towards and away from threads being woven into the fabric. As a latch needle is moved forwards and backwards, its latch swivels back and forth to alternately open and close the latch needle hook so that the latch needle can catch and hold one of the threads being woven into the fabric, pull it to create a loop of fabric, and then release the thread to repeat the cycle.

In rotary knitting machines the needles in an array are held in a cylindrical geometry and rapidly moved, in a rotary motion, into and out of the activation station. Depending upon the fabric being knitted, different ones of the needles moving through the activation station are activated. In linear knitting machines, latch needles are held in parallel slots in large flat needle beds. The activation station is a type of shuttle that moves rapidly back and forth over the needle bed, activating needles appropriate to the weave of the fabric being knitted.

In both rotary and linear knitting machines, a device called a "selector" determines (hereafter referred to as "selects") whether a needle in the activation station of the knitting machine is to be activated or not. To prevent a needle from being activated, the selector presses on a small protuberance (hereafter referred to as an "activation fin" or "fin") on the shaft of the needle. When pressure is applied to the activation fin by the selector, the needle moves away from an activating mechanism of the activator station and is "deactivated". If the selector does not press on the activation fin, the needle is activated.

The selector presses on the fin of a needle, to deactivate the needle, with a "selector foot". The selector foot has two operational selection positions. In a deactivate selection position, the selector foot presses on the fin of the needle thereby preventing the needle from being activated when the needle passes through the activation station. In an activate selection position, the selector foot does not press on the fin of the needle, thereby allowing the needle to be activated when the needle passes through the activation station. The selector foot is generally switched between the selection positions by displacing the selector foot by a small linear translation or by rotating the selector foot through a small angle.

When a knitting machine is operating, the selector of the knitting machine is set to an appropriate selection position for each latch needle that passes through the activation station of the knitting machine. If the selection positions for two needles that pass consecutively through the activation station are not the same the selector has to be switched from one selection position to the other. Prior art selectors generally use solenoids or piezoelectric bimorph actuators to effect the displacements necessary to switch a selector foot between selection positions. However, using these types of actuators, the time it takes to switch a selector foot between selection positions is too long to match the rate at which modern knitting machines move needles through activation stations.

In order to improve the speed with which prior art selectors operate, prior art selectors generally comprise a multiplicity of selector feet which are operated in parallel. In a selector operating with one selector foot, a decision to switch or not switch the selection position of the selector foot, hereafter referred to as "setting" the selector foot, has to be made and executed for every needle that moves through an activation station. In a selector with N activation feet on the other hand, each foot has to be set once for every N needles that move through the activation station. If the switching time needed to switch a selector foot between selection positions is $\tau$ secs, a selector with one foot can select $1/\tau$ needles/sec, or equivalently, operate at a "decision" frequency of $1/\tau$ Hz. A selector with N selector feet in parallel on the other hand, can select $N/\tau$ needles/sec, i.e. operate at a decision frequency of $N/\tau$ Hz. Switching times for prior art activation feet are on the order of 10 msecs. By operating approximately 10 activation feet in parallel, prior art selectors are able to operate at decision frequencies of up to about 1000 Hz.

The decision frequencies at which prior art selectors operate limit the rate at which needles can be moved through a knitting machine activation station and therefore limit the rate at which fabric can be produced. In order to increase the rate at which knitting machines produce fabric, it is desirable to have selectors that can operate at frequencies higher than 1000 Hz.

SUMMARY OF THE INVENTION

It is an object of some aspects of the present invention to provide a selector for knitting machines that can operate at decision frequencies substantially higher than 1000 Hz.

A selector, in accordance with a preferred embodiment of the present invention, achieves decision frequencies higher than those of conventional selectors by decreasing the switching time of selector feet comprised in the selector to less than the switching times of selector feet in conventional selectors.

When in operation, a selector foot constantly switches back and forth between selection positions at a rapid rate. When switching between selection positions, the selector foot generally moves a distance of about 2 mm in about 10 msecs. This change is resisted by friction, forces arising from part wear, machine design and tolerances, and random motional forces that occur during machine operation. The sum of these forces is on the order of between 0.2 and 0.5 Newton. Because of the close spacing within modem knitting machines and the small sizes of many of their components there is little room available for motors or actuators to provide the work required to accomplish the switching. An actuator or motor that can be used to improve the switching time of a selector foot in a selector must therefore be small, capable of switching direction rapidly and able to provide work at a greater rate than that available from motors or actuators in conventional selectors.

Piezoelectric motors can be produced that are small and powerful for their size and that can provide large accelerations of moveable elements in directions which can be reversed in time periods of microseconds. The switching time of a selector foot can be reduced to less than the switching times of selector feet in conventional selectors by using an appropriate piezoelectric motor to switch the selector foot between selection positions, in accordance with a preferred embodiment of the present invention. A selector foot, in accordance with a preferred embodiment of the present invention, is coupled to a piezoelectric motor that can displace a moveable element at a rate of about 400 mm/sec against a force opposing the motion which is on the order of from 0.2 to 0.5 Newton. Preferably, the selector foot comprises a friction coupling surface region suitable for friction coupling with the piezoelectric motor. Preferably, the selector foot is coupled to the piezoelectric motor by resiliently pressing a surface region of the piezoelectric motor, or an appropriate hard friction nub attached to the surface of the piezoelectric motor, to the friction coupling surface region of the selector foot. Preferably, the piezoelectric motor coupled to the selector foot is of a type described in U.S. Pat. No. 5,453,653, which is incorporated herein by reference. As a result, a selector foot in a selector, in accordance with a preferred embodiment of the present invention, can be switched between selection positions in a time on the order of 5 msec (2 mm/[400 mm/sec]=5 msec).

A selector, in accordance with a preferred embodiment of the present invention, comprises a multiplicity of activation feet, in accordance with a preferred embodiment of the present invention, operated in parallel. Preferably, the number of the multiplicity of selector feet is on the order of 10. With a switching time for the selector feet of 5 msec, in accordance with a preferred embodiment of the present invention, this results in a decision frequency for the selector in the range of 2000 Hz (the decision frequency=N/$\tau$ with N=10 and $\tau$=5 msec).

There is therefore provided in accordance with a preferred embodiment of the present invention a selector for a knitting machine, which knitting machine comprises a plurality of latch needles and an activation station, such that when a latch needle of the plurality of latch needles is in the activation station, said selector determines whether said latch needle is activated or not activated, comprising: at least one selector foot selectively positionable to an activate or a deactivate selection position, wherein said selector foot has a friction coupling surface; and a piezoelectric motor coupled to said friction coupling surface of the at least one selector foot; wherein vibrations in said piezoelectric motor cause said at least one selector foot to switch between activate and deactivate selection positions. Preferably, the piezoelectric motor is coupled to the friction coupling surface by a resilient force which presses a contact surface of the piezoelectric motor to the friction coupling surface. Alternatively, the piezoelectric motor has a friction nub and the piezoelectric motor is coupled to the friction coupling surface by a resilient force which presses the friction nub to the friction coupling, surface.

In some preferred embodiments of the present invention the friction coupling surface is cylindrical. In other preferred embodiments of the present invention the friction coupling surface is planar.

In some preferred embodiments of the present invention vibrations in the piezoelectric motor cause the selector foot to switch between selection positions by rotating the selector foot through a given angle. Preferably, the vibrations in the piezoelectric motor rotate the selector foot through the given angle in a period of time less than 10msec. More preferably, the vibrations in the piezoelectric motor rotate the selector foot through the given angle in a period of time less than 7 msec. Most preferably vibrations in the piezoelectric motor rotate the selector foot through the given angle in a period of time less than 5 msec. In some preferred embodiments of the present invention, the vibrations in the piezoelectric motor rotate the selector foot through the given angle in a period of time substantially equal to 5 msec.

In yet other preferred embodiments of the present invention vibrations in the piezoelectric motor cause the selector foot to switch between selection positions by causing a given linear displacement in the position of the selector foot. Preferably, the vibrations in the piezoelectric motor cause the given linear displacement in the position of the selector foot in a period of time less than 10 msec. More preferably, vibrations in the piezoelectric motor cause the given linear displacement in the position of the selector foot in a period of time less than 7 msec. Most preferably the vibrations in the piezoelectric motor cause the given linear displacement in the position of the selector foot in a period of time less than 5 msec. In some preferred embodiments of the present invention vibrations in the piezoelectric motor cause the given linear displacement in the position of the selector foot in a period of time substantially equal to 5 msec.

In some preferred embodiments of the present invention the at least one selector foot comprises a plurality of selector feet and each latch needle is associated with a particular one of the plurality of selector feet and when a latch needle is in the activation station the latch needle is activated or not activated according to the selection position of the particular selector foot of the plurality of selector feet with which the latch needle is associated. Preferably, each of the plurality of selector feet is coupled to a different piezoelectric motor.

There is further provided, in accordance with a preferred embodiment of the present invention, a method for switching a selector foot between an activate selection position and a deactivate selection position comprising: a) providing said selector foot with a friction coupling surface; b) coupling a piezoelectric motor to said friction coupling surface; and c) using vibrations of said piezoelectric motor to switch said selector foot between said activate selection position and said deactivate selection position. Preferably, coupling the piezoelectric motor to the friction coupling surface comprises pressing a contact surface of the piezoelectric motor to the friction coupling surface with a resilient force. Preferably, the piezoelectric motor has a friction nub and coupling the piezoelectric motor to the friction coupling surface comprises pressing the friction nub to the friction coupling surface with a resilient force.

Preferably, providing the selector foot with a friction coupling surface comprises forming a cylindrical friction surface. Alternatively, providing the selector foot with a friction coupling surface comprises forming a planar friction surface.

In some preferred embodiments of the present invention using vibrations of the piezoelectric motor to switch the selector foot between the activate selector position and the deactivate selector position, comprises using the vibrations to rotate the selector foot through a given angle. Preferably, using vibrations of the piezoelectric motor to switch the selector foot comprises using the vibrations to rotate the selector foot through the given angle in a period of time less than 10 msec. More preferably, using vibrations of the piezoelectric motor to switch the selector foot comprises using the vibrations to rotate the selector foot through the given angle in a period of time less than 7 msec. Most preferably, using vibrations of the piezoelectric motor to switch the selector foot comprises using the vibrations to rotate the selector foot through the given angle in a period of time less than 5 msec. In some preferred embodiments of the present invention using vibrations of the piezoelectric motor to switch the selector foot, comprises using the vibrations to rotate the selector foot through the angle in a period of time substantially equal to 5 msec.

In other preferred embodiments of the present invention, using vibrations of the piezoelectric motor to switch the selector foot, comprises using the vibrations to cause a given linear displacement in the position of the selector foot. Preferably, using vibrations of the piezoelectric motor to switch the selector foot, comprises using the vibrations to cause the given linear displacement in a period of time less than 10 msec. More preferably, using vibrations of the piezoelectric motor to switch the selector foot, comprises using the vibrations to cause the given linear displacement in a period of time less than 7 msec. Most preferably, using vibrations of the piezoelectric motor to switch the selector foot, comprises using the vibrations to cause the given linear displacement in a period of time less than 5 msec. In some preferred embodiments of the present invention using vibrations of the piezoelectric motor to switch the selector foot, comprises using the vibrations to cause the given linear displacement in a period of time substantially equal to 5 msec.

BRIEF DESCRIPTION OF FIGURES

The invention will be more clearly understood by reference to the following description of a preferred embodiment thereof read in conjunction with the attached figures listed below, wherein identical structures, elements or parts which appear in more than one of the figures are labeled with the same numeral in all the figures in which they appear, and in which.

DETAILED DESCRIPTION OF PREFERRED EMBODIMENTS

Figure 1:
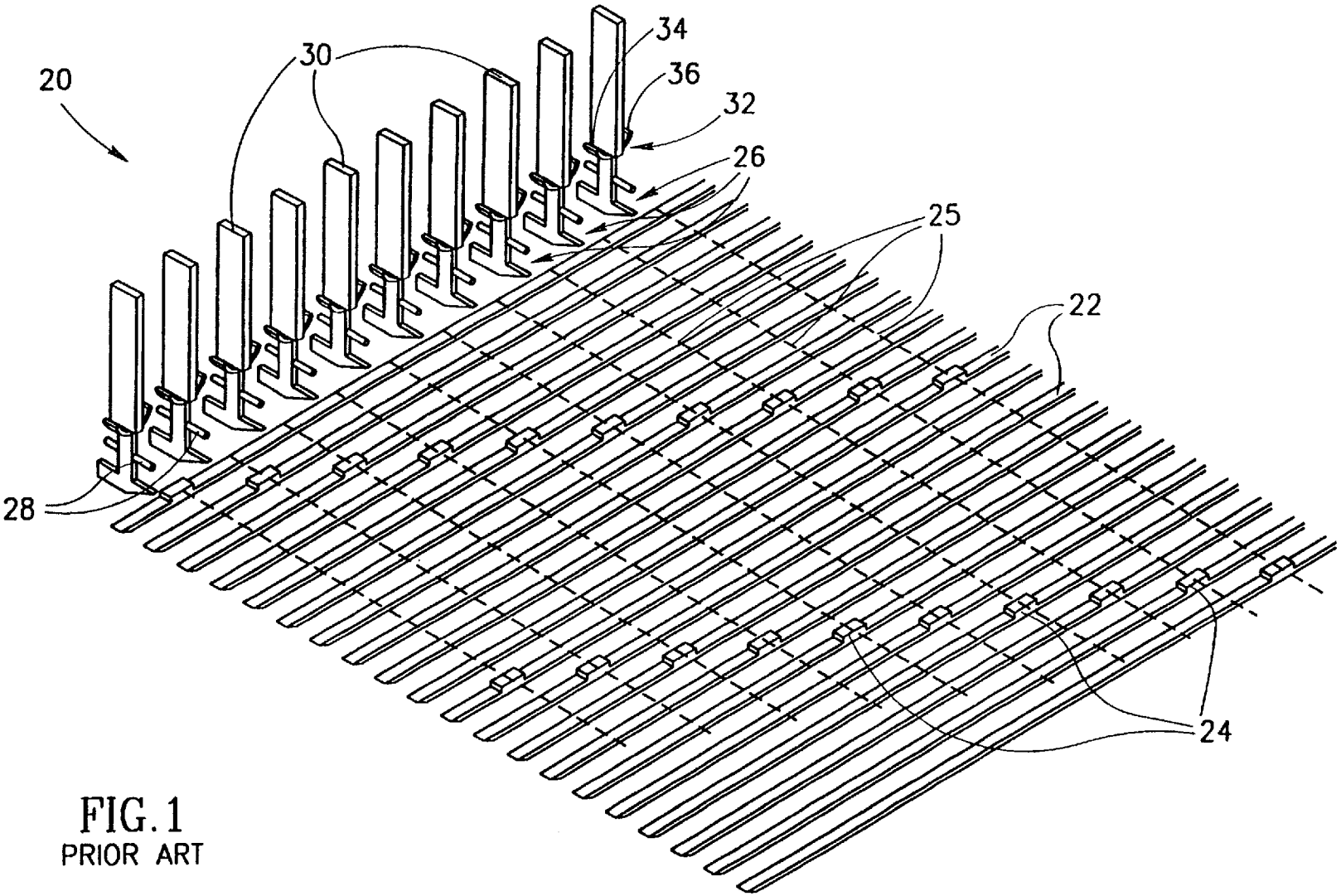
FIG. 1 PRIOR ART
FIG. 1 shows a schematic of parts of a conventional selector used with a shuttle type activation station in a linear knitting machine having a needle bed.

FIG. 1 shows a schematic of parts of a conventional selector 20 used with a shuttle type activation station in a linear knitting machine having latch needles held in a needle bed. In this and in the other figures only those parts of the knitting machine, selector and latch needles are shown that are needed for understanding the operation of the selector shown in the figure. The knitting machine needle bed holds a plurality (typically thousands) of latch needles with shafts 22 formed with activation fins 24 in a closely packed parallel array in which the needles are equally spaced from each other. Activation fins 24 are staggered at different positions along the lengths of shafts 22, and shafts 22 are positioned in the needle bed in such a manner, that activation fins 24 are accurately aligned in N parallel equally spaced rows perpendicular to shafts 22. In FIG. 1A, N=10. The rows are indicated by dashed lines 25 and the first two activation fins 24 of each row are shown. Between any two consecutive activation fins 24 in a row of activation fins 24 there are N−1 latch needles, i.e., the distance between two consecutive activation fins 24 in a same row of activation fins 24 is N times the distance between adjacent latch needles.

Selector 20 comprises a selector frame (not shown) and an array of N selector feet 26. Selector feet 26 are mounted in a row in the selector frame so that they are parallel to each other and equally spaced one from the other. Each selector foot 26 is mounted to the frame by means of a pin 28 around which selector foot 26 is rotatable. A bimorph activator 30 is coupled to each selector foot 26 by a U coupler 32 having arms 34 and 36. The space between adjacent selector feet 26 is equal to the space between adjacent rows of activation fins 24.

Selector 20 moves together with the shuttle activation station of the knitting machine as the activation station shuttles back and forth over the knitting machine's needle bed. Selector 20 moves over and parallel to the needle bed and in a direction parallel to the rows, i.e., parallel to lines 25, of activation fins 24, with each selector foot 26 maintained accurately aligned over and close to a different row of activation fins 24. Each selector foot 26 therefore moves over latch needle shafts 22 in the needle bed along a different row of activation fins 24 and encounters an activation fin 24 once for every N needle shafts 22 that the selector foot 26 passes.

Figure 2A:
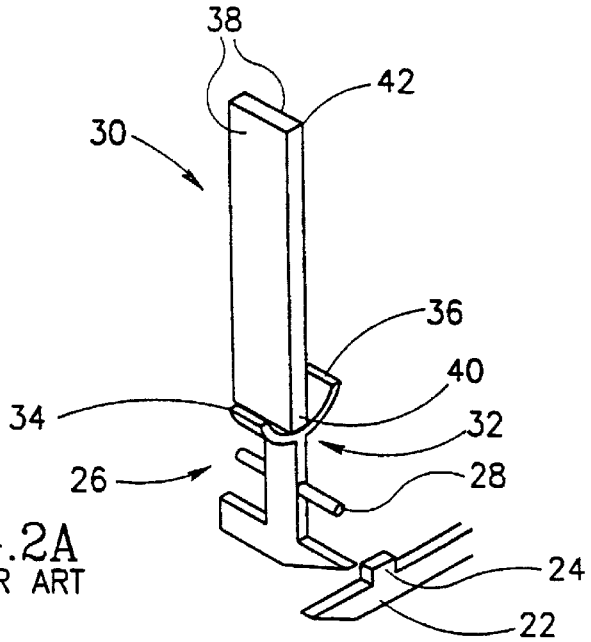
FIG.2A PRIOR ART
FIGS. 2A–2C show details of the construction and operation of a conventional selector foot.
Figure 2B:
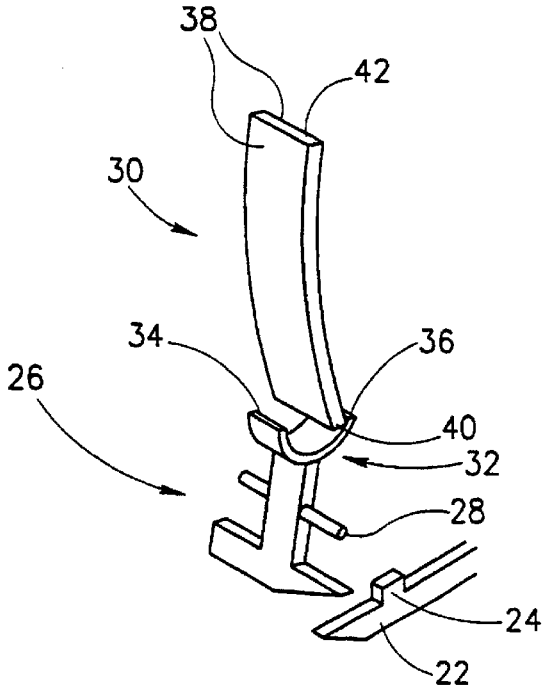
FIG.2B PRIOR ART
Figure 2C:
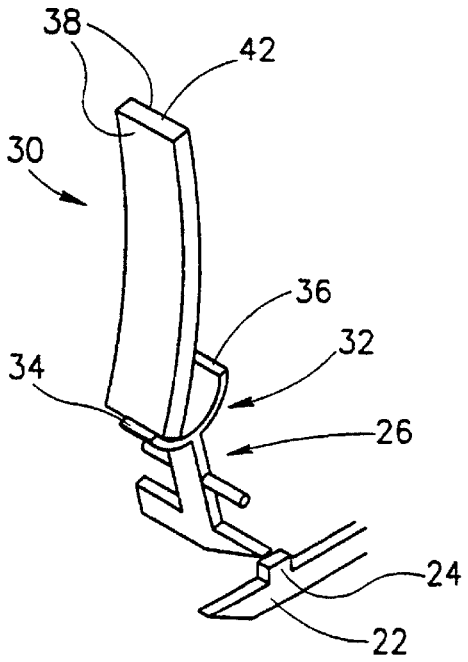
FIG.2C PRIOR ART

FIGS. 2A–2C show details of the construction and operation of a selector foot 26. FIG. 2A shows a bimorph activator 30 coupled to selector foot 26. Bimorph activator 30 is a long thin rectangular strip of piezoelectric material having large face surfaces 38 and ends 40 and 42. End 40 is situated between arms 34 and 36 of a U connector 32. End 42 of bimorph 30 is fastened to the frame (not shown) of selector 20. Bimorph activator 30 bends when a potential difference is applied between faces 38, otherwise bimorph 30 is straight. In FIG. 2A there is no potential difference between face surfaces 38, and bimorph 30 is straight. When a potential difference is applied between face surfaces 38, bimorph 30 bends into an arc shape with one of face surfaces 38 concave and the other convex. The direction of the bend depends upon the polarity of the applied potential. The bend causes end 40 to displace and, depending on the polarity of the applied potential, push against and apply a force to arm 34 or arm 36 of U coupler 32.

FIG. 2B shows bimorph 30 when a potential difference is applied between face surfaces 38 that causes bimorph 30 to bend so that end 40 presses on arm 36 of U connector 32. The pressure exerted by end 40 on arm 36 causes selector foot 26 to rotate clockwise through a small angle. FIG. 2C shows bimorph 30 when a potential difference is applied between face surfaces 38 which is opposite in polarity to the potential difference applied to face surfaces 38 in FIG. 2B. In this case bimorph 30 bends in a direction opposite to the bend direction shown in FIG. 2B, and end 40 of bimorph 30 presses on arm 34 of U connector 32. The pressure exerted by end 40 on arm 34 causes selector foot 26 to rotate counterclockwise through a small angle. The size of the angle through which selector foot 26 rotates when end 40 presses on one of arms 34 or 36 depends upon the amplitude of the voltage applied between face surfaces 38.

In FIG. 2C, the potential difference applied between face surfaces 38 of bimorph 30 is sufficient to cause selector foot 26 to rotate clockwise by an angle large enough so that selector foot 26 is in a deactivate selection position. In this selection position, as selector 20 moves along rows of activation fins 24, selector foot 26 will "collide" with and depress any activation fin 24 that it encounters. This will deactivate the needle to which the activation fin 24 is connected.

In FIG. 2B, on the other hand, a potential difference is applied between face surfaces 38 of bimorph 30 which has a polarity opposite to the potential difference applied to face surfaces 38 in FIG. 2C and which is large enough to cause selector foot 26 to rotate clockwise into an activate selection position. In this position selector foot 26 is out of the way of onrushing activation fins and when it encounters an activation fin 22, it will not collide with the activation fin 24. It will "miss" and pass by the activation fin 24 and not depress it. The latch needle to which the activation fin 24 is connected will therefore be activated by the activation station.

Figure 3:
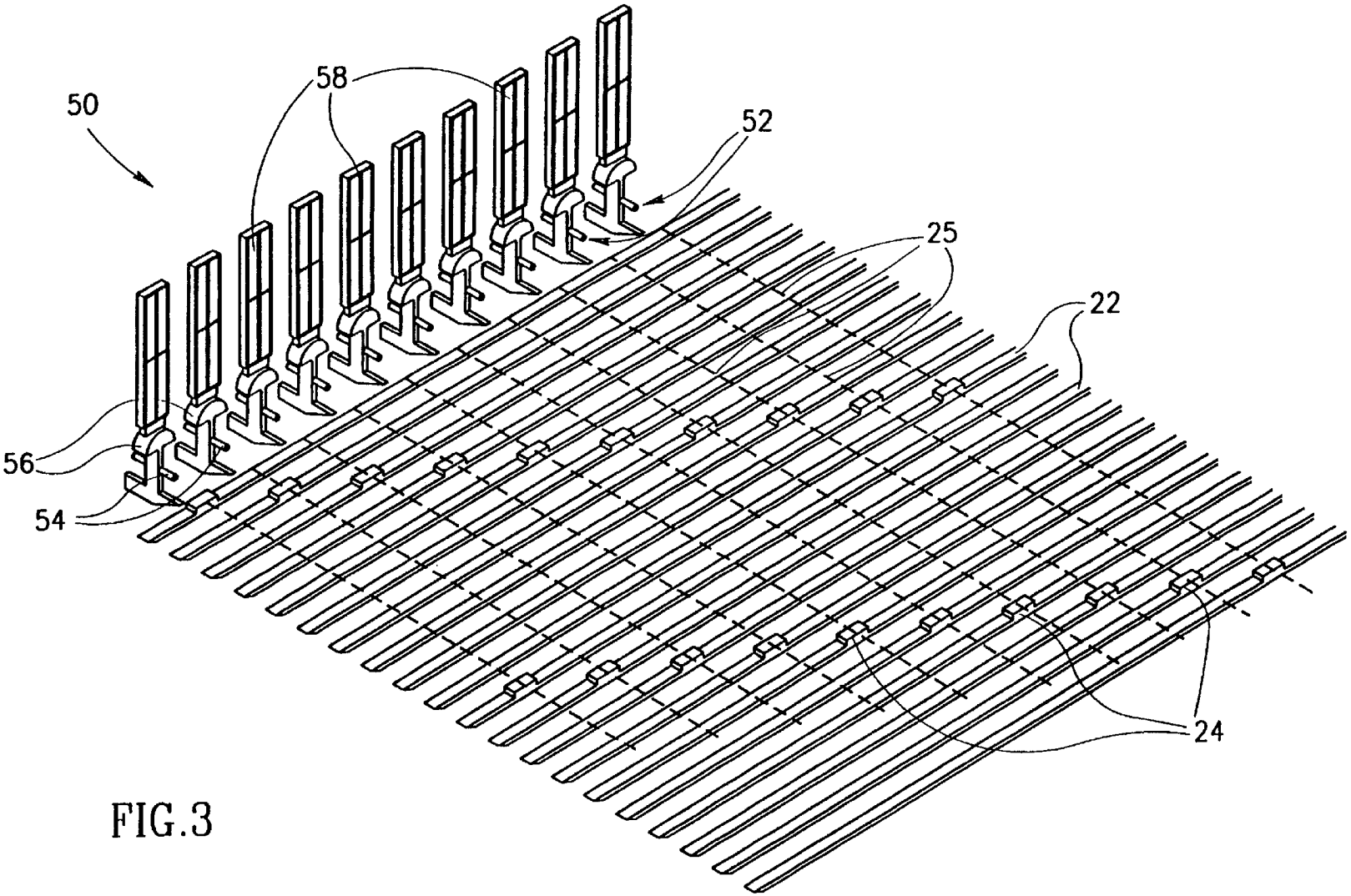
FIG. 3 shows schematically parts of a selector, in accordance with a preferred embodiment of the present invention for use with the same shuttle type activation station and linear knitting machine shown in FIG. 1.

FIG. 3 shows schematically parts of a selector 50, in accordance with a preferred embodiment of the present invention, for use with the same shuttle type activation station and linear knitting machine with which the prior art system shown in FIG. 1 is used.

Selector 50 preferably comprises a selector frame (not shown) and an array of N selector feet 52. N is preferably on the order of 10 (FIG. 3 is shown with N=10). Selector feet 52 are preferably mounted in a row in the selector frame so that selector feet 52 are preferably parallel to each other and equally spaced one from the other. Each selector foot 52 is mounted to the frame by means of a pin 54 around which selector foot 52 is rotatable. Selector foot 52 is preferably formed with, or mounted with, a friction coupling surface 56. Friction coupling surface 56 is preferably a circularly cylindrical surface with axis congruent with the axis of pin 54. Friction coupling surface 56 couples selector foot 52 to a piezoelectric motor 58 which is mounted to the selector frame by methods known in the art. The space between adjacent selector feet 52 is equal to the space between adjacent rows of activation fins 24.

Figure 4A:
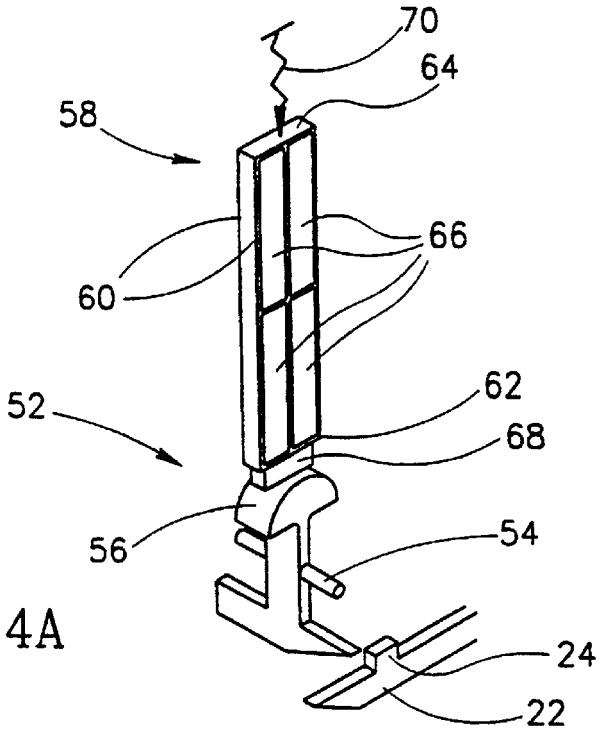
FIGS. 4A–4C show the details of construction and operation of a selector foot in accordance with a preferred embodiment of the present invention.
Figure 4B:
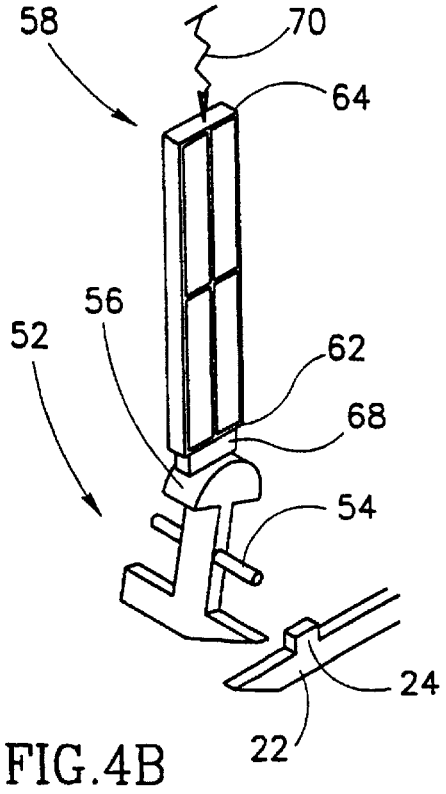
Figure 4C:
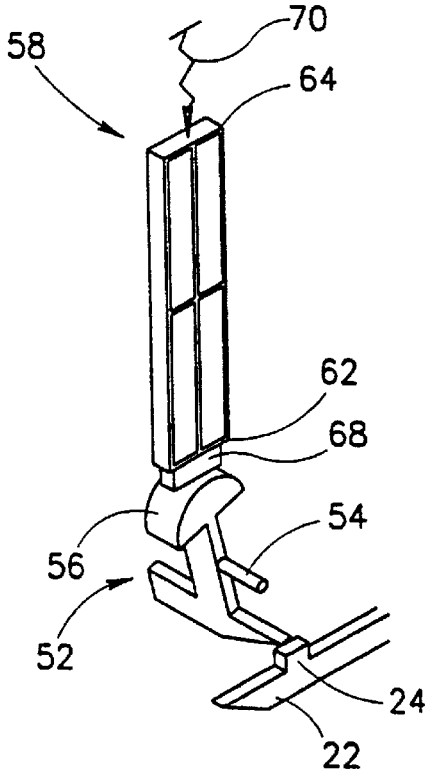

FIGS. 4A–4C show the details of construction and operation of a selector foot 52. Referring to FIG. 4A, selector foot 52 is shown between activate and deactivate selection positions, in the same orientation with respect to the needle bed of the knitting machine as the orientation of selector foot 26 in FIG. 2A.

Piezoelectric motor 58 is preferably formed in the shape of a thin rectangular plate having two large planar faces 60, and short edge surfaces 62 and 64. For exciting vibrations in the body of piezoelectric motor 58 one planar face surface 60 preferably has at least two surface electrodes and the other planar face surface 60 preferably has at least one surface electrode. Preferably, piezoelectric motor 58 has four quadrant surface electrodes 66 on one face surface 60 and a ground surface electrode on the other, hidden face surface 60. Piezoelectric motor 58 preferably has a friction nub 68 fixed to edge surface 62, for coupling to friction coupling surface 56. Preferably, piezoelectric motor 58 is of the type described in U.S. Pat. No. 5,453,653.

Friction nub 68 is preferably pressed to friction coupling surface 56 by a resilient force 70 applied between short edge 64 and a frame (not shown)of selector 50. Quadrant electrodes 66 and the ground electrode of piezoelectric motor 58 are preferably connected to a control circuit (not shown) which electrifies them to produce vibrations in the body of piezoelectric motor 58 as described in U.S. Pat. No. 5,453,653. The vibrations preferably produce clockwise or counterclockwise elliptical motion in friction nub 68 which produce respectively clockwise or counterclockwise frictional forces tangent to friction coupling surface 56. These frictional forces produce torques which rotate selector foot 52 clockwise and counterclockwise to switch selector foot 52 respectively into a deactivate selection position or an activate selection position. FIG. 4B shows selector foot 52 in a clockwise, activate selection position, and FIG. 4C shows selector foot 52 in a counterclockwise, deactivate selection position.

Preferably, piezoelectric motor 58 can displace a moveable element at a rate of about 400 mm/sec against a force opposing the motion on the order of from 0.2 to 0.5 Newton. At this rate of displacement, assuming the radius of friction coupling surface 56 is 10 mm, piezoelectric motor 58 can rotate selector foot 52 at an angular velocity of about 40 radians/sec or about 2350°/sec. Assuming selector foot 52 must be rotated about 15° to switch selector foot 52 from a deactivate to an activate selection position, selector foot 52 can be switched between selection positions, according to a preferred embodiment of the present invention, in a switching time of about 5 msec.

A selector 50, in accordance with a preferred embodiment of the present invention, having 10 selector feet 52 operating with a switching time of 5 msec operates at a decision frequency of 2000 Hz.

The present invention has been described using a non limiting detailed description of a preferred embodiment thereof. Variations of the embodiment described will occur to persons of the art. For example, a selector foot can be constructed so that instead of being rotated to switch between selection positions, the selector foot is displaced linearly to switch between selection positions. In this case a friction coupling surface of the selector foot would be a planar surface and selector feet would be mounted to a selector frame so that they slide along appropriate linear guides in the selector. It should also be realized that switching time is a function of the way in which the piezoelectric motor is coupled to the selector foot, the dimensions of the selector foot and the amplitude of the motion needed to switch the selector foot between selection positions. For the cylindrical friction coupling surface described above and a piezoelectric motor of constant speed (and variable power output), for example, switching time is proportional to the radius of the friction coupling surface. Additionally, while the detailed description of a preferred embodiment of the present invention refers to a selector used with a linear knitting machine, a selector in accordance with a preferred embodiment of the present invention, is similarly constructed for selecting latch needles in rotary knitting machines.

The detailed description is provided by way of example and is not meant to limit the scope of the invention which is limited only by the following claims:

1. A selector for a knitting machine, which knitting machine comprises a plurality of latch needles and an activation station, such that when a latch needle of the plurality of latch needles is in the activation station, said selector determines whether said latch needle is activated or not activated comprising:

at least one selector foot selectively positionable to an activate or a deactivate selection position, wherein said selector foot has a friction coupling surface; and a piezoelectric motor coupled to said friction coupling surface of the at least one selector foot; wherein vibrations in said piezoelectric motor cause said at least one selector foot to switch between activate and deactivate selection positions.

2. A selector according to claim 1 where in said piezoelectric motor is coupled to said friction coupling surface by a resilient force which presses a contact surface of said piezoelectric motor to said friction coupling surface.

3. A selector according to claim 1 where in said piezoelectric motor has a friction nub and wherein said piezoelectric motor is coupled to said friction coupling surface by a resilient force which presses said friction nub to said friction coupling surface.

4. A selector according to claim 1 wherein said friction coupling surface is cylindrical.

5. A selector according to claim 1 wherein vibrations in said piezoelectric motor cause said selector foot to switch between selection positions by rotating said selector foot through a given angle.

6. A selector according to claim 5 wherein vibrations in said piezoelectric motor rotate said selector foot through said given angle in a period of time less than 10 msec.

7. A selector according to claim 5 wherein vibrations in said piezoelectric motor rotate said selector foot through said given angle in a period of time less than 7 msec.

8. A selector according to claim 5 wherein vibrations in said piezoelectric motor rotate said selector foot through said given angle in a period of time less than 5 msec.

9. A selector according to claim 5 wherein vibrations in said piezoelectric motor rotates said selector foot through said given angle in a period of time substantially equal to 5 msec.

10. A selector according to claim 1 wherein said friction coupling surface is planar.

11. A selector according to claim 1 wherein vibrations in said piezooelectric motor cause said selector foot to switch between selection positions by causing a given linear displacement in the position of said selector foot.

12. A selector according to claim 11 wherein vibrations in said piezoelectric motor cause said given linear displacement in the position of said selector foot in a period of time less than 10 msec.

13. A selector according to claim 11 wherein vibrations in said piezoelectric motor cause said given linear displacement in the position of said selector foot in a period of time less than 7 msec.

14. A selector according to claim 11 wherein vibrations in said piezoelectric motor cause said given linear displacement in the position of said selector foot in a period of time less than 5 msec.

15. A selector according to claim 11 wherein vibrations in said piezoelectric motor cause said given linear displacement in the position of said selector foot in a period of time substantially equal to 5 msec.

16. A selector according to claim 1 wherein the at least one selector foot comprises a plurality of selector feet and wherein each latch needle is associated with a particular one of the plurality of selector feet and when a latch needle is in the activation station said latch needle is activated or not activated according to the selection position of the particular selector foot of the plurality of selector feet with which said latch needle is associated.

17. A selector according to claim 16 wherein each of the plurality of selector feet is coupled to a different piezoelectric motor.

18. A method for switching a selector foot between an activate selection position and a deactivate selection position comprising:

a) providing said selector foot with a friction coupling surface;

b) coupling a piezoelectric motor to said friction coupling surface; and c) using vibrations of said piezoelectric motor to switch said selector foot between said activate selection position and said deactivate selection position.

19. A method according to claim 18 wherein coupling said piezoelectric motor to said friction coupling surface comprises pressing a contact surface of said piezoelectric motor to said friction coupling surface with a resilient force.

20. A method according to claim 19 wherein said piezoelectric motor has a friction nub and wherein coupling said piezoelectric motor to said friction coupling surface comprises pressing said friction nub to said friction coupling surface with a resilient force.

21. A method according to claim 18 wherein providing said selector foot with a friction coupling surface comprises forming a cylindrical friction surface.

22. A method according to claim 18 wherein using vibrations of said piezoelectric motor to switch said selector foot between said activate selector position and said deactivate selector position, comprises using said vibrations to rotate said selector foot through a given angle.

23. A method according to claim 22 wherein using vibrations of said piezoelectric motor to switch said selector foot comprises using said vibrations to rotate said selector foot through said given angle in a period of time less than 10 msec.

24. A method according to claim 22 wherein using vibrations of said piezoelectric motor to switch said selector foot comprises using said vibrations to rotate said selector foot through said given angle in a period of time less than 7 msec.

25. A method according to claim 22 wherein using vibrations of said piezoelectric motor to switch said selector foot comprises using said vibrations to rotate said selector foot through said given angle in a period of time less than 5 msec.

26. A method according to claim 22 wherein using vibrations of said piezoelectric motor to switch said selector foot, comprises using said vibrations to rotate said selector foot through said angle in a period of time substantially equal to 5 msec.

27. A method according to any of claims 18–20 wherein providing said selector foot with a friction coupling surface comprises forming a planar friction surface.

28. A method according to claim 18 wherein using vibrations of said piezoelectric motor to switch said selector foots comprises using said vibrations to cause a given linear displacement in the position of said selector foot.

29. A method according to claim 28 wherein using vibrations of said piezoelectric motor to switch said selector foot, comprises using said vibrations to cause said given linear displacement in a period of time less than 10 msec.

30. A method according to claim 28 wherein using vibrations of said piezoelectric motor to switch said selector foot, comprises using said vibrations to cause said given linear displacement in a period of time less than 7 msec.

31. A method according to claim 28 wherein using vibrations of said piezoelectric motor to switch said selector foot, comprises using said vibrations to cause said given linear displacement in a period of time less than 5 msec.

32. A method according to claim 28 wherein using vibrations of said piezoelectric motor to switch said selector foot, comprises using said vibrations to cause said given linear displacement in a period of time substantially equal to 5 msec.

33. A selector according to claim 1 wherein said piezoelectric motor has a contact surface that is resiliently pressed to said friction coupling surface.

34. A selector according to claim 33 wherein said piezoelectric motor comprises a friction nub and said contact surface is a surface of the friction nub.

35. A selector for a knitting machine, which knitting machine comprises a plurality of latch needles and an activation station, such that when a latch needle of the plurality of latch needles is in the activation station, said selector determines whether said latch needle is activated or not activated, comprising:

at least one selector foot selectively positionable to an activate or a deactivate selection position, wherein said selector foot has a friction coupling surface; and a piezoelectric motor having a contact surface pressed against said friction coupling surface of the at least one selector foot to couple the motor to the at least one selector foot;

wherein vibrations in said piezoelectric motor cause said at least one selector foot to switch between activate and deactivate selection positions.

36. A selector for a knitting machine according to claim 35 wherein said motor is resiliently pressed to said friction coupling surface.

* * * * *